United States Patent [19]

Stryjewski

[11] 4,046,468

[45] Sept. 6, 1977

[54] METHOD AND APPARATUS FOR CLEANING FUSING MEMBERS OF ELECTROGRAPHIC COPIERS

[75] Inventor: Walter A. Stryjewski, Hilton, N.Y.

[73] Assignee: Eastman Kodak Company, Rochester, N.Y.

[21] Appl. No.: 649,779

[22] Filed: Jan. 16, 1976

Related U.S. Application Data

[63] Continuation-in-part of Ser. No. 510,847, Sept. 30, 1974, abandoned.

[51] Int. Cl.[2] ..... G03G 15/00

[52] U.S. Cl. ..... 355/3 R; 118/652; 355/15; 427/22; 432/75

[58] Field of Search ..... 355/3 FU, 3 R, 15; 118/652, 70, 60, 308; 15/1.5; 432/75; 427/22, 203

[56] References Cited

U.S. PATENT DOCUMENTS

| | | | |
|---|---|---|---|
| 3,268,351 | 8/1966 | Van Dorn | 117;335/21;3 FU |
| 3,291,466 | 12/1966 | Aser et al. | 355/3 FU |
| 3,324,791 | 6/1967 | Cassano et al. | 355/14 X |
| 3,706,491 | 12/1972 | Furman et al. | 355/3 FU |
| 3,796,183 | 3/1974 | Thettu | 355/15 X |
| 3,861,860 | 1/1975 | Thettu et al. | 355/15 X |
| 3,861,861 | 1/1975 | Thettu | 355/15 X |
| 3,878,818 | 4/1975 | Thettu et al. | 355/15 X |
| 3,883,292 | 5/1975 | Hamaker | 355/3 FU |
| 3,937,637 | 2/1976 | Moser et al. | 355/3 FU |

FOREIGN PATENT DOCUMENTS

| | | | |
|---|---|---|---|
| 2,224,971 | 12/1973 | Germany | 355/3 FU |

*Primary Examiner*—Richard L. Moses
*Attorney, Agent, or Firm*—G. W. Neuner

[57] ABSTRACT

An electrographic copier and process wherein an image-bearing support material has toner particles fused thereto by a heated pressure member, the pressure member being kept clean of contaminants by a fusible resinous powder distributed over the support material and toner particles prior to the fusing step.

14 Claims, 5 Drawing Figures

METHOD AND APPARATUS FOR CLEANING FUSING MEMBERS OF ELECTROGRAPHIC COPIERS

RELATION TO OTHER APPLICATIONS

This application is a continuation-in-part application of U.S. application Ser. No. 510,847 now abandoned filed Sept. 30, 1974.

BACKGROUND OF THE INVENTION

1. Field of the Invention

The invention concerns the field of electrographic reproduction, and specifically, apparatus and a process whereby the pressure member involved in fusing the image to the support material or copy sheet is kept clean of extraneous debris which commonly builds up from the copy sheets contacted by the pressure member.

2. State of the Prior Art

Electrographic imaging and developing processes, e.g., electrophotographic imaging processes and techniques, have been extensively described in both the patent and other literature, for example, U.S. Pat. Nos. 2,221,776, issued Nov. 19, 1940; 2,277,013, issued Mar. 17, 1942; 2,297,691, issued Oct. 6, 1942; 2,357,809, issued Sept. 12, 1944; 2,551,582, issued May 8, 1951; 2,825,814, issued Mar. 4, 1958; 2,833,648, issued May 6, 1958; 3,220,324, issued Nov. 30, 1965; 3,220,831, issued Nov. 30, 1965; 2,330,822, issued Nov. 30, 1965; Research Disclosure, Vol. 109, May 1973, publication 10938; and many others. Generally, these processes have in common the steps of forming a latent electrostatic charge image on an insulating electrographic element. the electrostatic latent image is then rendered visible by a development step in which the charged surface of the electrographic element is brought into contact with a suitable developer. The developed visible image relies upon an imagewise distribution of an opaque material, commonly known as a toner, usually deposited in a dry particle form. Electrostatic transfer of such toner particles to the support material, and their fusion by the application of heat, are well-known. Typically, the fixing or fusing step may be achieved by a pair of heated, counter-rotating rollers, commonly known as fusing rollers. Construction of such rollers, and methods of heating the same, are discussed in detail in Product Licensing Index, Vol. 99, July 1972, Publication No. 9944, pages 72 and 73.

The fusing rollers, by virtue of their repeated contact with the copy sheet, tend to build up debris in the form of paper fibers, lint and the like from the copy sheet, particularly in the areas of the sheet which do not bear a toner image. Thus, multiple copies of the same original cause the same non-imaged areas of the copy sheet to contact the rollers. Unless cleaning means are introduced, the continuous build-up of debris finally results in significant amounts of debris being transferred to the fusing roller so as to mask its required release characteristics.

To clean the rollers, it has been conventional to cover the roller initially with an abhesive surface, as explained in the aforesaid *Product Licensing Index.* However, these coverings are not only expensive to fabricate, they also are inherently heat insulative, requiring further treatment with materials of high heat conductivity in order to permit proper fusing by the rollers. Still other solutions of the problem have incorporated cleaning or release liquids either alone or in combination with abhesive covers, silicone oils being an example. Such liquids have proven to be effective only for short and generally unpredictable duration. Further, by being in liquid form they of necessity are characterized by handling problems, and under high heat conditions they can cause degradation of the abhesive layer. Typical examples of the use of release liquids and/or abhesive coatings can be found in U.S. Pat. Nos. 3,268,351, issued Aug. 23, 1966; 3,324,791, issued June 13, 1967 and 3,331,592, issued July 18, 1967.

Other publications pertinent to the background of cleaning apparatus for portions of electrographic copiers can be found in the following sources:

U.S. Pat. Nos. 3,411,932, issued on Nov. 19, 1968; 3,526,457, issued Sept. 1, 1970; 3,615,397, issued Oct. 26, 1971; 3,624,858, issued Dec. 7, 1971; 3,673,632, issued July 4, 1972; 3,686,035, issued Aug. 22, 1972; and *Product Licensing Index,* Vol. 94, February 1972, Publication No. 9406, pages 48–49.

Still another approach has been to run plain paper through the rollers at a slow rate and without developing material, as shown for example in U.S. Pat. No. 3,706,491. However, such an approach cleans only excess tone from the rollers, and not fibrous material. In fact, such a technique aggravates the problem of lint contamination. A different solution for the removal of toner, but not fibers, has involved the use of triboelectric cleaning granules impinged against the unwanted toner, such as is taught by U.S. Pat. No. 3,424,615 and U.S. Pat. No. 3,654,901. However, this process concerns only the cleaning of the photoconductive plate, and as with the case of plain paper, is in any case insufficient to clean paper fibers.

Resins of course have been coated on non-imaging papers for protective reasons rather than as a cleaner, and the following U.S. Patents are representative of such technology: U.S. Pat. Nos. 3,479,213; 3,112,985; 3,110,618; 2,790,735; 2,583,274; 2,434,106; 2,406,454 and 2,125,527. Liquid dispersions containing resins have also been deposited over unfused image powder on copy sheets or support material, of which examples can be found in U.S. Pat. No. 3,779,748, issued Dec. 18, 1973. However, such dispersions were designed for the properties given to the final copy, and are limited by the handling problems characteristic of all liquids.

OBJECTS OF THE INVENTION

Accordingly, in overcoming the aforestated problems, it is an object of the invention to provide apparatus and a process for keeping the fusing pressure member clean and free from objectionable lint and fibrous material.

It is a further object of the invention to provide such apparatus and such a process in a simplified manner which avoids the problems attendant with the use of liquid cleaners.

It is a related object of the invention to minimize the cost of the process of the invention.

Other objects and advantages will become apparent upon reference to the following Summary of the Invention and Detailed Description, when read together with the accompanying drawings.

SUMMARY OF THE INVENTION

The invention concerns apparatus and a process for maintaining the fusing pressure member of an electrographic copier free from fibrous contaminants such as lint and other surface material commonly released from plain paper support materials.

More specifically, there is provided an electrographic copying apparatus comprising means for forming a toner particle image on a surface of a sheet of a support material, a pressure member having a fusing surface area for fusing the toner particle image onto the support material, and depositing means for randomly distributing fusible, relatively dry, finely divided resinous powder onto portions of the support material surface before the support material surface contacts the pressure member, whereby the powder fuses to contaminants left on the pressure member and to portions of the support material to clean the pressure member. Further, a method of removing contaminants is achieved by the steps of distributing over at least the entire equivalent fusing area of a sheet of the support material, a fusible, relatively dry, finely-divided resinous powder; and thereafter impacting the support material surface and powder with the pressure member, the pressure member having conditions effective to adhere contaminants contained on the pressure member to the powder and to fuse the powder to the support material, thereby cleaning the pressure member. A preferred method is to distribute the powder over an unfused toner particle image so that the pressure member is cleaned while the image is fused.

DETAILED DESCRIPTION OF THE PREFERRED EMBODIMENTS

The invention features an electrographic copying apparatus, and a method of copying, wherein the fusing member is kept clean of debris which heretofore has particularly plagued fusing members which contact the final copy.

Figure 1:
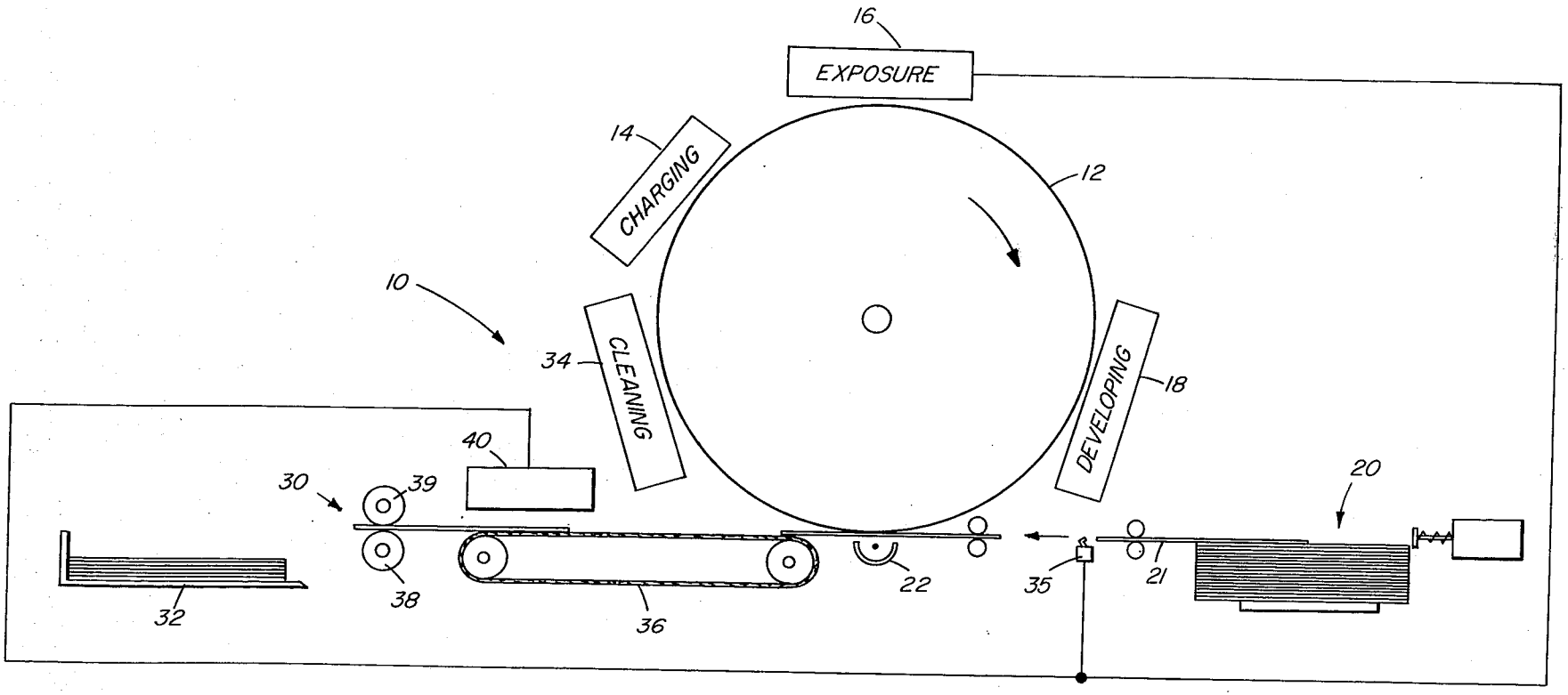
FIG. 1 is a schematic illustration of a copying apparatus constructed in accordance with the invention.

Turning now to FIG. 1, there is schematically shown an electrographic copying apparatus 10 which comprises means for forming a toner particle image on a support material; a heated pressure member 39 for fusing the toner particle image onto the support material; a support material collection station 32; a drum cleaning station 34; and a copy counter 35. The forming means conventionally feature an electrostatically chargeable dielectric member 12, an electrostatic charging station 14 for forming a uniform electrostatic charge image on member 12; an exposure station 16 which imagewise exposes member 12 and dissipates its non-imaged portions to form a latent electrostatically charged image, a developing station 18 for depositing toner particles onto the member 12, thus developing the image into imagewise distributed toner particles; positioning means including a feed station 20 for feeding the support material 21 to a position adjacent to the member 12; and a transfer station 22 for transferring the particles from member 12 to the support material.

The electrostatically chargeable member can be in any desirable form, such as a conventional rotating drum as shown. Useful compositions of the member 12 include a drum-shaped support, and adhered or otherwise attached to the support, a dielectric composition such as heterogenous multi-phase photoconductive materials as disclosed in the aforesaid U.S. Pat. No. 3,615,414, or a homogeneous composition such as a solid solution of poly(4,4'-isopropylidenebisphenoxyethyl-co-ethylene terephthalate) and a 4,4'-bis(diethylamino)-2,2'-dimethyltriphenylmethane photoconductor.

The charging station 14 may be any type, for example, it can be a corona discharge device. Developing station 18 can be any mechanism for imagewise forming a layer of toner. A preferred form of the developing step is to contact the dielectric member with toner particles, whereby a triboelectric charge between the particles and the electrostatic image attracts and holds the particles to the member in an imagewise fashion corresponding to the latent electrostatic image, forming a toner particle image. It is contemplated that conventional cascade, magnetic brush, or powder cloud stations can be used to release the fine powder form of the toner. These and the other stations, except for the cleaning station described below, are well-known in the art and can have a variety of forms, so that nothing is gained from further descriptions thereof.

In accordance with one aspect of the invention there is provided, as a cleaning means, a station 40, described in detail hereinafter, for randomly distributing fusible, relatively dry, finely divided, colorless transparent resinous powder 42 (FIG. 2) onto portions of the support material 21, on the surface thereof which already bears the imagewise transferred, but unfused, toner particles. Station 40 is positioned subsequent to the transfer station 22 with regard to the path of travel of support material 21.

So that the fuser may fix both the particles of cleaning powder and image toner particles to the support, it is preferred that both fuse satisfactorily and under nearly like conditions. In this way, no special separate requirements are made of the fuser and its surface contaminants are removed as it functions to fix the images. Thus among the various powders which may be employed as the cleaning medium of the present invention are any toner particles. Particularly useful powders include polystyrene containing resins, polycarbonates, rosin modified maleic alkyd resins, polyamides, phenol-formaldehyde resins and various derivatives thereof, polyester condensates, modified alkyd resins and the like, aromatic resins containing alternating methylene and aromatic units such as described in Merrill et al, U.S. Pat. No. 3,809,554, issued May 7, 1974, and fusible cross-linked polymers as described in Jadwin et al, U.S. Ser. No. 380,317, now abandoned filed July 18, 1973, and the like, both applications being commonly owned with the instant application.

Although it is preferred that the particles lack a colorant, colorants can be used if they give only a background tint or color that does not interfere with the image legibility.

Especially useful as a powder are certain polycarbonates such as those described in U.S. Pat. No. 3,694,359 issued Sept. 26, 1972, and which include polycarbonate materials containing an alkylidene diarylene moiety in a recurring unit and having from 1 to about 10 carbon atoms in the alkyl moiety. Other useful powder having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful.

Still other especially useful resins are various styrene-containing resins. Such polymers typically comprise a polymerized blend of from about 40 to about 100 percent by weight of styrene, including styrene homologs; from about 0 to about 45 percent by weight of one or more lower alkyl acrylates or methacrylates having from 1 to about 4 carbon atoms in the alkyl moiety such as methyl, ethyl, isopropyl, butyl, etc; and from about 0 to about 50 percent by weight of one or more vinyl monomers other than styrene, for example, a higher alkyl acrylate or methacrylate (including branched alkyl and cycloalkyl acrylates and methacrylates) having from about 6 to 20 or more carbon atoms in the alkyl group. A typical styrene-containing resin prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl methacrylate. Especially useful styrene-containing binder resins are cross-linked fusible styrene-containing polymers such as described in the abovereferenced Jadwin et al patent application incorporated herein by reference thereto.

A useful powder is a polymer consisting essentially of about 7% by weight of polyvinyl butyral and about 93% by weight of a copolymer of styrene and n-butyl methacrylate. In this case, the particle size should be about 10 microns.

A variety of other useful styrene containing materials are disclosed in the following U.S. Pat. Nos.: 2,917,460 issued Dec. 15, 1959; Re 25,316 issued Mar. 13, 1962; 2,788,288 issued Apr. 9, 1957; 2,638,416 issued Apr. 12, 1953; 2,618,552 issued Nov. 18, 1952 and 2,659,670 issued Nov. 17, 1953.

The amount of surface area of the sheet of the support material to be coated is preferably at least an area equivalent to the circumferential surface area of the fuser roller 39. Thus, as used herein the "equivalent fusing area" of the sheet is that which completely contacts the circumferential surface area of the roller 39. The distribution over this area is preferably an even or uniform coating, but unevenness can be tolerated as long as it does not interfere with removal of contaminants.

The support material 21, so coated, is transferred by the belt or rollers 36 on which it is conveyed, to the pressure members 30 which fuse the image toner particles. As is conventional, the pressure members preferably comprise a pair of counter-rotating rollers 38 and 39 having a temperature sufficient to fuse the particles. The roller 39 achieves the actual fusion of toner particles and cleaning powder, while roller 38 is a back-up roller or anvil which permits the pressure to be applied. At this point, under the heat and pressure of the rollers the powder 42 melts and fuses to any contaminants which may be on the roller 39. Because the softened powder preferentially adheres to the support material 21, it and the contaminants are carried away without the continued build up of contaminants on the roller. Any suitable heating temperature may be used for the rollers, as long as it is sufficient to melt the resinous powder. The precise temperature will of course be governed by the powder selected.

By this means, every sheet or support material 21 can be coated with powder 42. Preferably, the depositing of the powder is achieved such that the coating of the powder is between about 0.4 milligrams and about 2.0 milligrams per square decimeter of surface of the material 21. Above this amount, no significant improvement in cleaning of roller 39 occurs. A representative amount of such coating is 0.6 milligrams per square decimeter. By coating every sheet, a minimum of contaminants build up on the roller.

Alternatively, the apparatus can be electronically controlled by conventional circuitry such that, at regular intervals, only every nth sheet is so coated. The value of $n$ is an integer greater than 1 and preferably is sufficiently small such that the build-up of contaminants between coated sheets, which is then deposited on the "cleaning" sheet, does not impair the quality of the copy of the "cleaning" sheet. This in turn is governed by the type of paper or the support material 21, and the amount of non-imaged space. Thus, $n = 50$ might be acceptable for a given condition of operation. A counter can conventionally actuate the cleaning station 40 after ($n$-1) sheets have passed under the fuser.

As will be readily appreciated, the fusing members 30 can advantageously simultaneously fuse the image toner particles while melting the powder which cleans the rollers.

Figure 2:
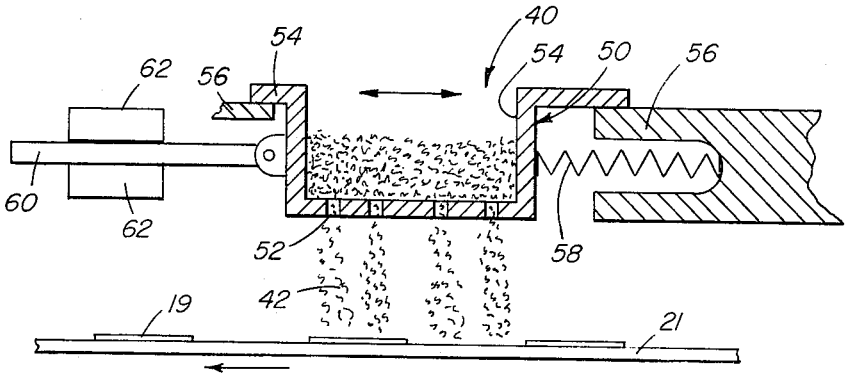
FIGS. 2 through 5 are partially schematic, fragmentary elevational views illustrating alternate embodiments of the cleaning station of the invention.

FIG. 2 illustrates one form of the depositing means 40 for depositing the powder. Thus, it may comprise a container 50 having a foraminous bottom 52 and impervious side walls 54, translatably mounted on supports 56. A compression spring 58 biases one side wall 54, while to agitate or reciprocate the container, a drive rod 60 is connected to the opposite side wall 54. The rod in turn may be activated by a drive member such as solenoids 62 against the action of spring 58, whereby powder is caused to fall from the container and randomly coat the surface of material 21 and the image toner particles 19 thereon.

Figure 3:
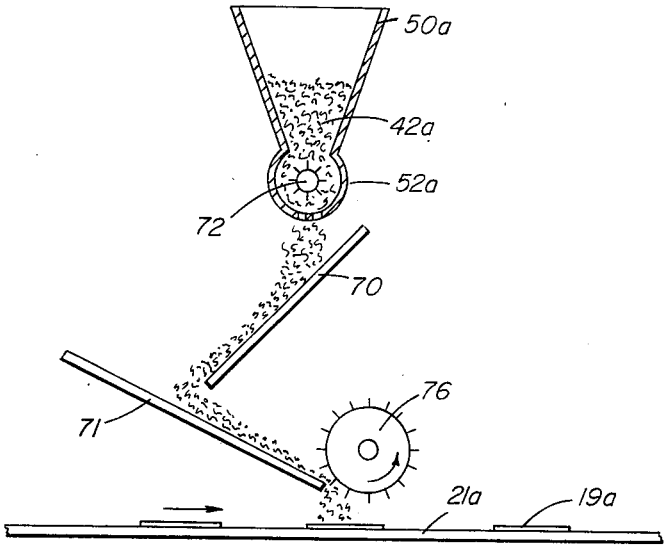
Figure 4:
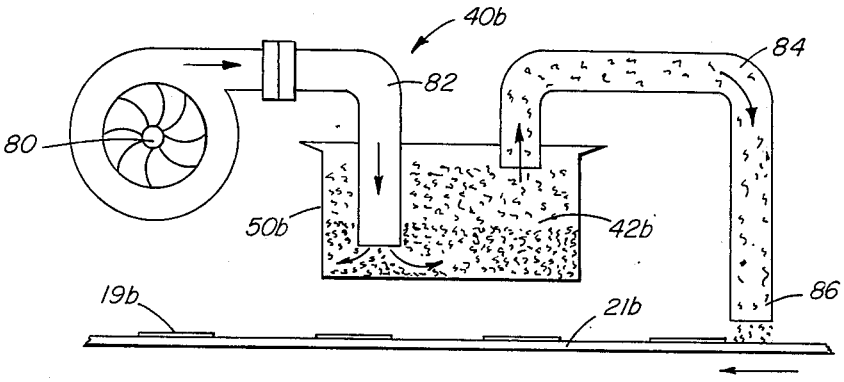
Figure 5:
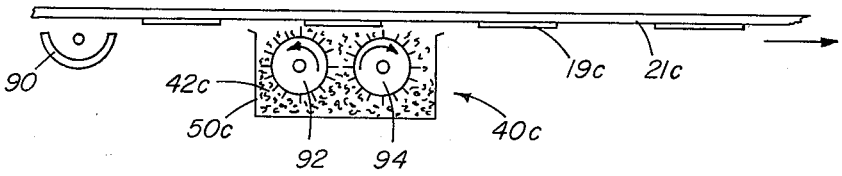

Turning now to FIGS. 3–5, there are illustrated alternate embodiments of depositing means 40. Parts similar to those previously described bear the same reference numeral to which the distinguishing suffices *a, b* and *c* have been added.

Thus, in FIG. 3 the powder 42*a* is impinged upon generally planar members 70 by means of a rotating agitator 72, such as a brush, which ejects powder out of a reservoir 50*a* provided with holes or apertures in the bottom surface 52*a* thereof. To break up agglomerations of the powder into a evenly distributed form, it is caused to cascade over the members 70, which preferably are mutually inclined and vibrated by suitable conventional means, not shown. Another rotating agitator 76, such as a second brush, is used to assist in the displacing of the powder in a random fashion over the material 21*a* bearing imaged toner particles 19*a.*

In FIG. 4, means 40*b* comprises a reservoir or container 50*b,* a centrifugal fan or blower 80, conveyor tubes 82 and 84, and a nozzle 86, for cascading the powder over the surfaces of the tube 84 prior to random deposition onto the material 21*b.* The depositing means 40*c* of FIG. 5 features as before a container 50*c* for powder 42*c.* However, here means are provided for electrostatically charging the material 21*c* with a charge opposite to that of the untoned paper. Conventionally, such means can be a corona discharge device 90. To form a charged cloud of the powder capable of being triboelectrically attracted to the charge formed on material 21*c,* an agitator is provided such as two conventional counter-rotating bristle brushes 92 and 94. It will be readily apparent that this embodiment is particularly preferred in those cases in which the support material comes to the fusing rollers with the toner particle image faced downwardly.

It will be readily appreciated that all of the stations, the rollers, including rollers 38 and 39, the depositing means 40, and the member 12 are synchronously driven and sequenced by conventional motors and electrical controls, all of which are well-known. Thus, the circuitry preferably is constructed, for example, to turn on the depositing means only when the sheet 21 to be coated is sensed to be in position at station 40 for the coating.

EXAMPLES

The following examples are included by way of illustration only, and they are not in any way exclusive.

| A toner formulation was prepared as follows: | |
|---|---|
| Carbon black | 4 parts |
| Tetrapentyl ammonium chloride | 1 part |
| Terpolymer of polystyrene, methylmethacrylate and 2-ethylhexyl methacrylate | 100 parts |

The carbon black is, of course, preferably not used in actual practice. It was included in the test as a means of visually determining the extent of the coating of the powder over the sheet.

This powder was randomly deposited during seven runs over 20 lb. weight paper bond copy sheets free of surface treatment, so that the amount of powder was as set forth in the six examples of the following Table. The size of the paper sheet in all cases was 2.16 decimeter by 2.8 decimeter.

TABLE

| Example No. | Milligrams of Powder on Sheet | Results |
|---|---|---|
| 1 | 1.0 | Debris continued to build up on roller |
| 2 | 2.0 | Debris continued to build up on roller |
| 3 | 2.5 | Threshhold of acceptable removal of debris (erratic) |
| 4 | 3.0 | Threshhold (consistent) |
| 5 | 3.5 | Acceptable removal of debris |
| 6 | 4.0 | Acceptable removal of debris |

Above 4 milligrams, this powder was not as suitable, as little additional cleaning was realized. Thus, for the particular formationof this formulation of the preferred range is about 0.5 to about 0.6 milligrams per square decimeter of sheet. This figure may vary slightly for powders of other compositions, particularly the upper limit. Thus, other examples using a toner having a higher polystyrene content as per the teaching of U.S. Pat. No. 2,788,288, in place of the powder described above, produced similar results except a coating of 5 milligrams of that powder on the paper sheet gave acceptable results.

The invention has been described in detail with particular reference to preferred embodiments thereof, but, it will be understood that variations and modifications can be effected within the spirit and scope of the invention.

What is claimed is:

1. An electrographic copying apparatus comprising
means for forming a toner particle image on a surface of a sheet of a support material,
a pressure member for fusing the toner particle image onto the support material, and
depositing means for distributing fusible, relatively dry, finely-divided resinous powder onto at least a portion of the support material surface before the support material surface contacts the pressure member,
whereby the powder melts and fuses to the support material, carrying contaminants left on said pressure member with the powder to clean said pressure member.

2. The apparatus as defined in claim 1 wherein said depositing means include a reciprocally movable container, the bottom of the container being foraminous; and means for mounting the container for reciprocal movement, whereby resinous powder confined within the container is caused to fall therefrom in a random pattern when the reciprocating means is activated.

3. The apparatus as defined in claim 2, wherein said mounting means includes a compression spring adjacent to one end of said container and a drive member adjacent to the opposite end of the container.

4. The apparatus as defined in claim 1 wherein said depositing means include means for cascading the powder over a surface.

5. The apparatus as defined in claim 4 wherein said surface comprises two vibrating, relatively inclined planes.

6. The apparatus as defined in claim 4 and further including a container of the powder and means for ejecting powder from the container onto the surface.

7. The apparatus as defined in claim 6 wherein said ejecting means include a blower positioned so as to force powder to flow from the container over the surface.

8. The apparatus as defined in claim 1 wherein said depositing means include means for forming an electrostatic charge on the toner particle bearing support material, and means for forming a cloud of the powder adjacent to the electrostatically charged support material.

9. The apparatus as defined in claim 1 wherein said forming means include
a dielectric member;
means for forming a latent electrostatic image on the member;
means for developing the image into imagewise-distributed toner particles; and
transfer means for imagewise transferring the particles from said member to a surface of a support material.

10. An electrographic copying apparatus comprising
an image member having distributed over the surface thereof, a dielectric composition;
means for forming a latent electrostatic image on the drum member surface;
means for depositing toner particles on said surface so as to correspond with said electrostatic image, whereby a toner particle image is formed;
transfer means for imagewise transferring the particles from said member to a surface of a support material;
at least one vibrating member positioned subsequent to the transfer means and adjacent to the path of travel of said support material;
means for cascading a fusible, relatively dry colorless resinous powder onto said vibrating member, whereby the powder is broken into a randomly distributed fine form;

means for displacing said powder in its fine form from said vibrating member to said support material surface; and pressure rollers at least one of which is heated, said rollers being positioned subsequent to said cascading and displacing means with respect to the processing of the image-bearing support material, whereby said rollers can fuse the toner particles and can also fuse the powder, thus cleaning contaminants from the roller contacting the powder.

11. The apparatus as defined in claim 10 wherein said cascading means include a container of the powder and means for ejecting powder from the container onto a second vibrating member.

12. The apparatus as defined in claim 11 wherein said second vibrating member is inclined relative to, and positioned above, said one vibrating member, whereby the powder is cascaded from said second member onto said one member.

13. In an electrographic copying apparatus comprising means for forming a toner particle image on a surface of a sheet of a support material, a pressure member for fusing the toner particle image onto the support material, and cleaning means for keeping said member clear of contaminants which would impair image produced by the apparatus, the improvement wherein said cleaning means comprises depositing means for distributing fusible, relatively dry, finely divided resinous powder onto at least a portion of the support material surface before the support material surface contacts the pressure member, whereby the powder melts and fuses to the support material, carrying contaminants left on said pressure member with the powder to clean said pressure member.

14. Apparatus for removing contaminants adhered to a pressure member used to fuse toner particle images to a support material, the apparatus comprising sensing means for determining the passage of $(n-1)$ sheets under the pressure member, wherein $n$ is a positive integer greater than 1 and is sufficiently small as to prevent build-up of image-impairing contaminants on the pressure member, and means responsive to said sensing means for distributing a fusible, relatively dry, finely-divided resinous powder over generally the entire equivalent fusing area of every nth sheet of support material, prior to the passage of said nth sheet under the pressure member, the powder being distributed to clean the pressure member of contaminants.

* * * * *